United States Patent [19]

Alsch

[11] 4,390,855

[45] Jun. 28, 1983

[54] RESETTING DEVICE FOR MANUALLY OPERABLE ROTARY SWITCH

[75] Inventor: Gottfried Alsch, Vienna, Austria

[73] Assignee: Hubert Laurenz Naimer, Ascona, Switzerland

[21] Appl. No.: 295,492

[22] Filed: Aug. 24, 1981

[30] Foreign Application Priority Data

Sep. 25, 1980 [AT] Austria ..... 4802/80

[51] Int. Cl.[3] ..... H01H 9/00; H01H 67/02

[52] U.S. Cl. ..... 335/166; 335/116

[58] Field of Search ..... 335/116, 166, 26, 30

[56] References Cited

U.S. PATENT DOCUMENTS 3,036,174 5/1962 Ardia et al. ..... 335/116

FOREIGN PATENT DOCUMENTS 240809 8/1926 United Kingdom .
346606 4/1931 United Kingdom .
370444 4/1932 United Kingdom .
538582 8/1941 United Kingdom .
609228 9/1948 United Kingdom .

*Primary Examiner*—Harold Broome
*Attorney, Agent, or Firm*—Kurt Kelman

[57] ABSTRACT

The disclosure relates to a resetting device on a rotary switch for resetting the latter when the mains voltage falls below a predetermined limiting value, in which an electromagnet connectable to the power supply and equipped with an armature is provided, and this armature releases or blocks, in dependence on the state of excitement of the magnet, a return mechanism which subjects the rotary switch to a resetting from a switching position into a definite starting position.

With such a resetting device, the armature (8) of the electromagnet (7) controls at least one displaceable blocking tappet (13), which blocking tappet, in the case of a switch located in a switching position different from its starting position and with the armature (8) pulled up, rests against a projection (19) or engages into a depression of at least one restoring mechanism (16, 16') loaded by a return spring (21,22) and in drive connection with the drive or switch shaft (1). In this way, it is possible, to use such a resetting device also for a switch having several switching positions.

7 Claims, 6 Drawing Figures

RESETTING DEVICE FOR MANUALLY OPERABLE ROTARY SWITCH

DESCRIPTION

The invention relates to a resetting device on a rotary switch for resetting the latter when the mains voltage falls below a predetermined limiting value, in which an electromagnet connectable to the mains and equipped with an armature is provided, and this armature releases or blocks, in dependence on the state of excitement of the magnet, a return mechanism which subjects the rotary switch to a resetting from a switching position into a definite starting position.

In a known device of this type, there is a toggle-lever system which acts on an arm connected in a rotation-proof manner to the drive or switch shaft of the switch and in which there are compression springs attempting to press the toggle-lever system into an extended position corresponding to the starting position of the switch. Here, the electromagnet is located to the side of the drive or switch shaft and, with the armature pulled up, holds the toggle-lever system in the bent position via a pawl, when the switch assumes a switching position different from its starting position.

The disadvantage of this known device is the large number of bearing points required by the toggle-lever system and the relatively large space requirement of the toggle-lever system, so that such a system is practicable only for switches with a relatively large diameter or cross-section. The latter is due, above all, to the fact that the electromagnet has to be located to the side of the drive or switch shaft of the switch. Moreover, it is still necessary to provide devices which reliably prevent the toggle-lever system from bending out of the extended position in the wrong direction, as a result of which the construction of the resetting device is further complicated.

A further disadvantage of the known toggle-lever system is also that it is practicable solely for switches with two positions only, and not, for example, for switches with one "off" position and two "on" positions, for example for running to the right and to the left or for the selective connection of two consumers.

The object of the invention is to propose a resetting device of the type mentioned in the introduction, which can also be used for small rotary switches, especially those having a small diameter, and which is characterised by a simple construction. Furthermore, it will also be applicable to switches with more than two switching positions.

This is achieved, according to the invention, due to the fact that the armature of the electromagnet controls at least one displaceable blocking tappet, which blocking tappet, in the case of a switch located in a switching position different from its starting position and with the armature pulled up, rests against a projection or engages into a depression of at least one restoring mechanism loaded by a return spring and in drive connection with the drive or switch shaft. By means of these measures, the device according to the invention can, because of the blocking tappets interacting with projections or depressions, be adapted easily for switches with more than two switching positions, especially those with an "off" position between two "on" positions.

According to a further feature of the invention, it is envisaged that the electromagnet will be arranged coaxially to the drive or switch shaft of the rotary switch.

As a result of the coaxial arrangement of the electromagnet, it is possible to make do with a small space requirement of the device in a plane perpendicular to the drive or switch shaft, so that the resetting device according to the invention can be used even in relatively small rotary switches or those having a small diameter, without the need for an attachment which has a larger diameter and which would cause problems for installation in a control panel.

A preferred embodiment of the invention is characterised in that the restoring mechanism has a projection or depression extending in the direction of the drive or switch shaft, and, to achieve a compact construction, the blocking tappet or tappets are appropriately retained so as to be displaceable in the longitudinal direction of the drive or switch shaft.

It is also proposed, to achieve a simple construction, that each restoring mechanism be movable in a plane perpendicular to the drive or switch shaft. In this respect, it is especially advantageous if the restoring mechanism is designed as a disc located in a rotation-proof manner on the drive or switch shaft. In this way, it is very simple to bring switches which are rotatable to the right and to the left back into a central position in the event that the mains voltage falls too far. It is sufficient, for this purpose, to cause, for example, two oppositely acting coil springs to engage on the restoring mechanism, each of these being tensionable in one direction of rotation only, which can easily be achieved by means of an appropriate arrangement of stops acting on one side only. Moreover, with such a design of the restoring mechanism, it is also possible to cover relatively large angles of rotation of the switch shaft, so that even switches having "on" positions rotated by up to 120° relative to the "off" position can be provided with such a resetting device.

Furthermore, the resetting device according to the invention is characterised by a very simple construction. According to a further feature of the invention, it is envisaged that the electromagnet is designed as a pot magnet with a hollow core through which the drive or switch shaft passes, and the armature is designed as a plate which is provided with a bore which corresponds to the drive or switch shaft and through which the latter passes with play, and which has a depression, preferably an engraving, in the region of the core. It is thereby possible to connect the resetting device to conventional rotary switches or to equip it subsequently with such switches. In this case, it is merely necessary to prolong the drive shaft of the switch by means of a coupling, pass it through the resetting device and connect the housing of the switch and the resetting device to one another.

An especially simple and appropriate construction is obtained if the armature has at least one projection which projects into a recess of a blocking tappet, and a compression spring is supported on the wall of this recess and on the projection, the projection or projections or the depression of the restoring mechanism advantageously having flanks extending obliquely to its plane of movement and to its direction of movement and the blocking tappet or tappets having correspondingly extending flanks which can be brought to rest against said flanks. Thus, in practice, the prestress of the springs pressing the blocking tappets against the restoring mechanism or mechanisms is changed as a result of the pulling up or dropping of the armature, and, with the armature pulled up, the restoring mechanism is blocked or retained despite the spring force acting thereon. Only when the armature has dropped is the force of the spring or springs acting on the restoring mechanism or mechanisms sufficient to press back the blocking tappets and lift the switch shaft against the force of the contact springs back into the starting position of the switch. Moreover, manual actuation of the switch is made possible by means of the oblique flanks, in which case the springs of the blocking tappet or tappets are overridden.

A construction of the restoring mechanisms which utilises, in particular, the special properties of plastics is characterised in that the restoring mechanism or mechanisms are designed as racks which mesh with a toothed segment of the drive or switch shaft. It is ensured thereby that the releasing force acts directly on the rack which executes a linear movement, as a result of which a more precise mutual adaptation of the release faces and, consequently, a lower surface pressure become possible. The latter is particularly important because in plastics, as is known, friction depends to a considerable extent on the surface pressure and, consequently, special importance must be attached to a low surface pressure. A further advantage of this solution is also based on the fact that a spring which can be produced simply is sufficient, and this can be used in an optimum way. Moreover, this solution also makes it possible to select the transmission ratio between the restoring mechanism and shaft, thus permitting mutual coordination with the spring, so that the latter works in the optimum range of its force/displacement characteristic.

The invention is now explained in more detail with reference to the drawing in which.

Figure 1:
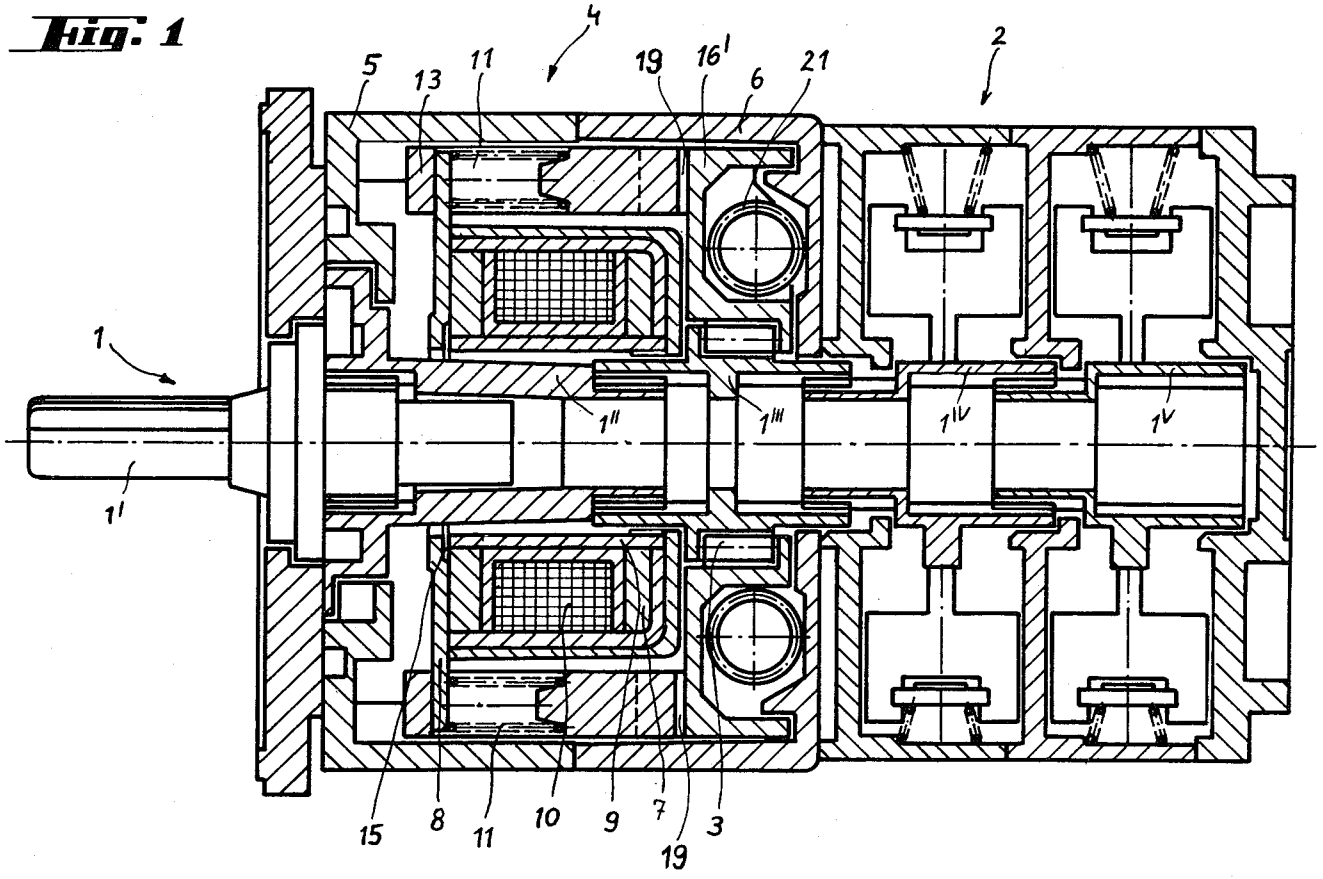
FIGS. 1 and 2 show a cross-section through a switch with a resetting device according to the invention, in the starting position of the switch and in a switching position.

In the exemplary embodiments illustrated, the drive or switch shaft 1 is formed by individual shaft segments 1'–$\mathbf{1}^{IV}$ having spline-like internal or external toothing, the segments $\mathbf{1}^{IV}$ and $\mathbf{1}^{V}$ controlling the two contacts in planes of the switch 2, and the segment 1''' being provided with an additional external toothing 3 for connecting in a non-rotative manner the shaft segments 1', 1'', extending in the resetting device 4, to the shaft segments $\mathbf{1}^{IV}$ and $\mathbf{1}^{V}$.

The resetting device 4 consists essentially of the two housing halves 5 and 6, in which the shaft segments 1'' and 1''' are mounted. A pot magnet 7 together with its armature 8 is inserted in the housing halves 5,6 or is guided in appropriate grooves of the housing half 5, the core 9 of the magnet being hollow and the shaft segments 1'' and 1''' passing through this core. The coil 10 of the magnet 7 is preferably supplied from the mains via a rectifier bridge.

The armature 8 has projections 12 engaging in recesses 14 of the blocking tappets 13 which are guided in grooves of the housing half 5 and can be displaced in the direction of the longitudinal axis of the drive or switch shaft 1. In this case, the blocking tappets 13 are supported on the armature 8 by compression springs 11 resting against the projections 12, different prestresses of the compression springs 11 being obtained with the armature 8 pulled up or dropped.

To guarantee that the armature 8 drops reliably when the supply voltage falls below a definite minimum voltage, a boss 15 ensuring the necessary air gap is provided in the region of the armature 8 lying opposite the core 9 of the pot magnet 7.

The blocking tappets 13 are pressed by the compression springs 11 against the restoring mechanism 16 (FIGS. 4–6) or the restoring mechanisms 16' (FIGS. 1–3), these being connected with movement to the drive or switch shaft 1, and the blocking tappets 13 are provided with a projection 18 which has oblique flanks 17 and by means of which they can be brought to rest against the projections 19, extending in the axial direction of the drive or switch shaft 1, of the restoring mechanism or mechanisms 16, 16'. The projections 19 also have oblique flanks 20, the angle of which corresponds to that of the flanks 17 of the projection 18 of the blocking tappets 13 and complementing the same to make an angle of approximately 90°.

The oblique flanks 20 of the restoring mechanisms 16 strike the flanks 17 of the blocking tappet 13 only after the magnet 7 has been energized or its armature 8 has been pulled up, and large holding forces of the magnet 7 are therefore effective, and slide along on one another, the compression springs 11 supported on the armature projections 12 and on the blocking tappets 13 being tensioned or overridden. Since, in the starting position of the switch or of the resetting device, the oblique flanks 20 of the projections 19 of the restoring mechanism or mechanisms 16, 16' do not touch the flanks 17 of the blocking tappet 13 and, consequently, the unit comprising the armature 8, compression spring 11 and blocking tappet 13 is freely movable in the region of the possible stroke, the magnet 7, when excited, can bring the armature 8 to rest with a lower pulling-up force.

Figure 2:
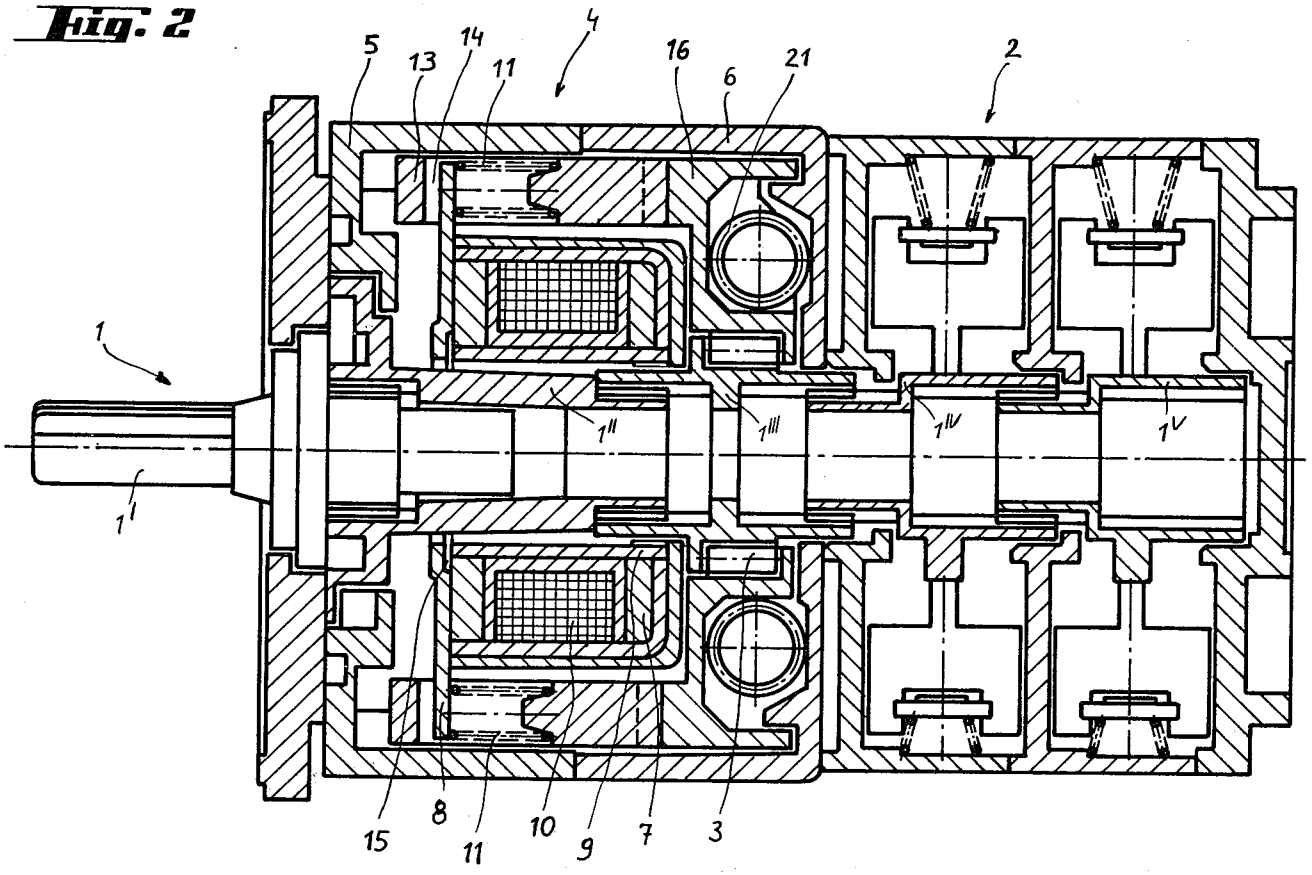
Figure 3:
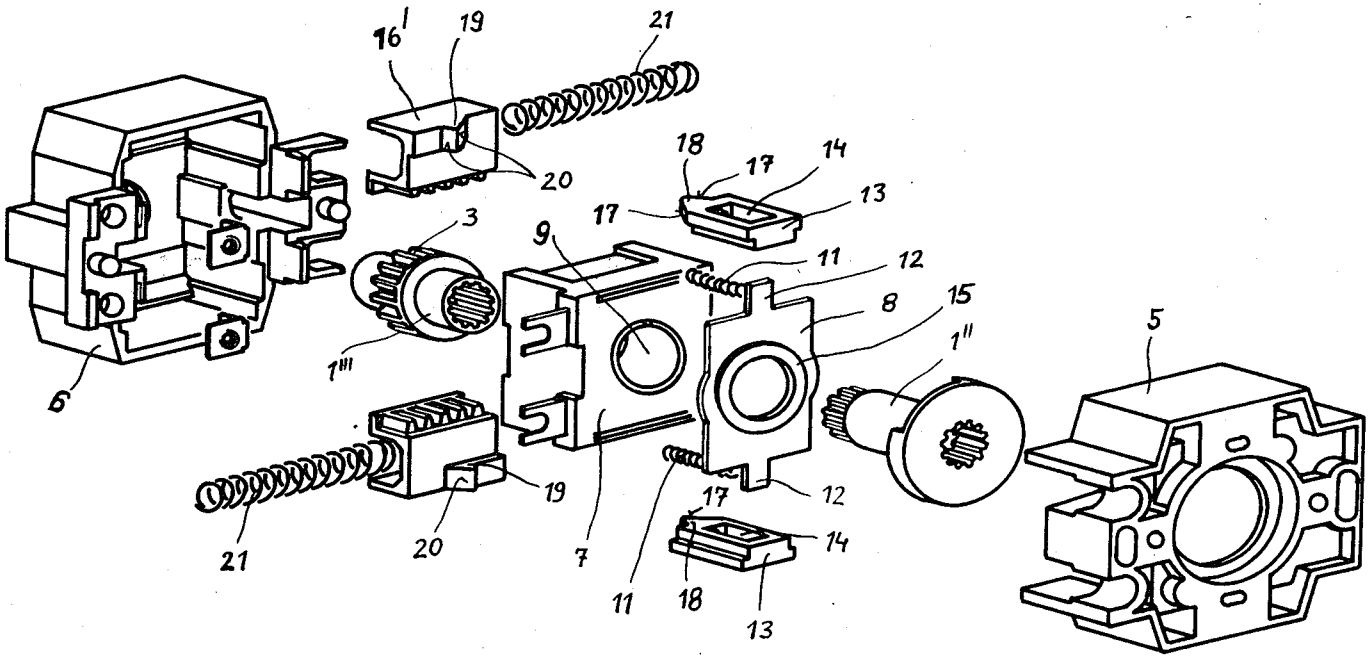
FIG. 3 shows an exploded drawing of the resetting device according to FIGS. 1 and 2.

In contrast to this, in the switching position different from the starting position of the switch or of the resetting device, the oblique flanks 20 of the restoring mechanism 16, 16' lie against the oblique flanks 17 of the blocking tappet 13, since the compression spring 11 presses the blocking tappet 13 against the restoring mechanism 16 (FIGS. 4 to 6) or the restoring mechanisms 16' (FIGS. 1–3). If the magnet is excited and its holding force is capable of keeping the compression spring 11 tensioned, the projections 19, lying against one another, of the restoring mechanism or mechanisms 16, 16' and the projections 18 of the blocking tappets 13 prevent the restoring mechanism or mechanisms 16, 16' from being able to turn the drive or switch shaft 1 back into the starting position, despite the load applied by the tensioned compression spring or springs 21, so that the resetting unit remains in a switching position different from the starting position. If, in this position, the holding force of the magnet 7 becomes less as a result of a voltage drop or voltage failure at the coil, this is no longer sufficient to absorb the force exerted by the compression springs 11 or the blocking tappets 13 which are also loaded by the compression springs 21 via the oblique flanks 17 of their projections and the flanks 20 of the projections 19 of the restoring mechanism or mechanisms 16, 16', as a result of which the armature 8 drops and, consequently, the prestress of the compression springs 11 and therefore also the blocking effect of the blocking tappets 13 which acts on the restoring mechanisms decrease. The force of the spring or springs 21 is then consequently sufficient to turn the restoring mechanism or mechanisms 16, 16' and, therefore, the drive or switch shaft 1 back into the starting position, overcoming the contact forces of the switch.

In the embodiment according to FIGS. 1 to 3, the restoring mechanisms 16' are designed as racks which mesh with the additional external toothing 3 of the shaft segment 1''' and against which rest compression springs 21 supported on the housing half 6, and, in the embodiment illustrated, when the drive or switch shaft 1 is deflected out of its position corresponding to the starting position of the switch 2, the springs 21 of the two restoring mechanisms are compressed and therefore tensioned. This embodiment is consequently suitable only for switches with two switching positions, but the resetting device 4 according to FIGS. 1 to 3 can be converted in a simple way into one with more than two positions. For this purpose, it is sufficient to support the two compression springs 21 on the same wall of the housing half 6 or to replace one of the two compression springs 21 by a tension spring so that, in one direction of rotation, the one spring is tensioned and in the other direction of rotation, the other spring is tensioned. This small change which, since the compression springs 21 rest against a transverse wall extending approximately in the centre of the restoring mechanisms 16', can also be made subsequently, specifically by simply reversing one of the compression springs 21, ensures that the resetting device 4 can also be used for switches having switching positions to the left and right of a starting position. If such an optional change-over is desired, there must, of course, be an appropriate play, in the starting position of the resetting device 4, between the walls of the housing half 6 and the restoring mechanisms 16', in order to permit an appropriate movement of the device in each direction. Moreover, the two springs 21 must be largely balanced in the starting position, so as not to exert any noteworthy torques on the drive or switch shaft 1. Furthermore, it is advantageous if the springs 21 have a very steep characteristic.

A further relatively simple possibility for adapting the resetting device 4 for use in connection with switches having more than two positions, in which the compression springs 21 are, again, supported on the same wall of the housing half 6 or one compression spring 21 is replaced by a tension spring, involves partly removing the external toothing 3 of the segment 1''' of the drive or switch shaft 1, so that, when the drive or switch shaft 1 is rotated out of its starting position to the left or to the right, only one of the restoring mechanisms 16' is ever moved out of its position of rest in which it stands against a wall of the housing half 6, and during this time the associated spring 21 is tensioned. In this case, since, in the starting position of the resetting device, the position of the restoring mechanisms 16' is determined by a mechanical stop, namely a wall of the housing half 6, the use of balanced springs 21 can be omitted.

As a rule, the starting position of the switch 2 will be its "off" position; however, since cam switches in the form of chambers are preferably attached to the resetting unit, no restrictions are necessary either in the number of contacts to be actuated or in their programme (break contact, make contact, change-over contact etc.). Thus, it is also possible to conceive applications, for example in fire protection systems, in which the "on" position of the switch is its starting position, that is to say, when the voltage is switched away from the coil 10 of the pot magnet 7, the latter closes its contacts, in order, for example, to activate a circuit for operating a sprinkler system or the like.

The coil 10 can be supplied directly by means of the circuit to be cut in or cut out by the switch 2 or by means of an auxiliary circuit.

Figure 4:
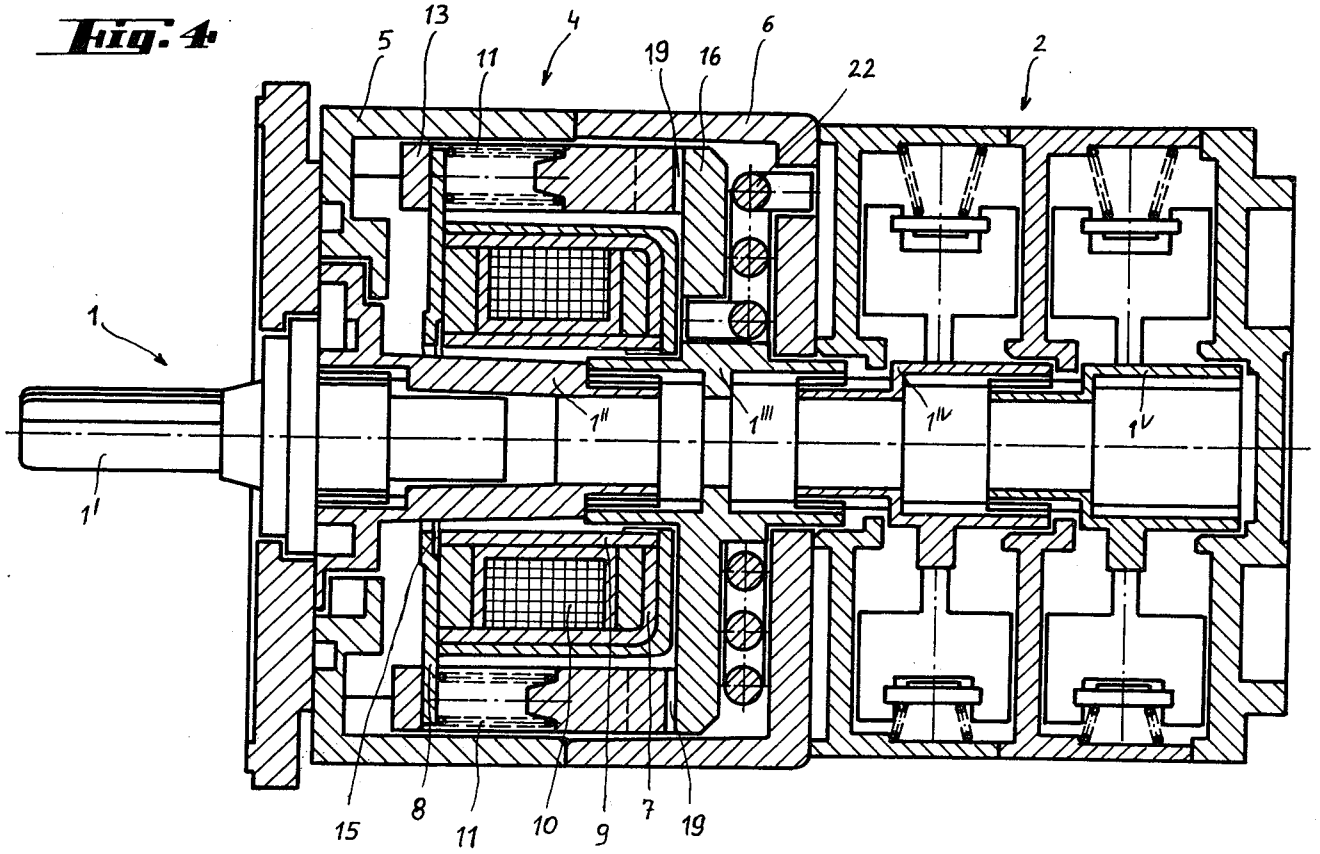
FIGS. 4 and 5 show cross-sections similar to FIGS. 1 and 2 through a second embodiment of a resetting device according to the invention, with a switch.
Figure 5:
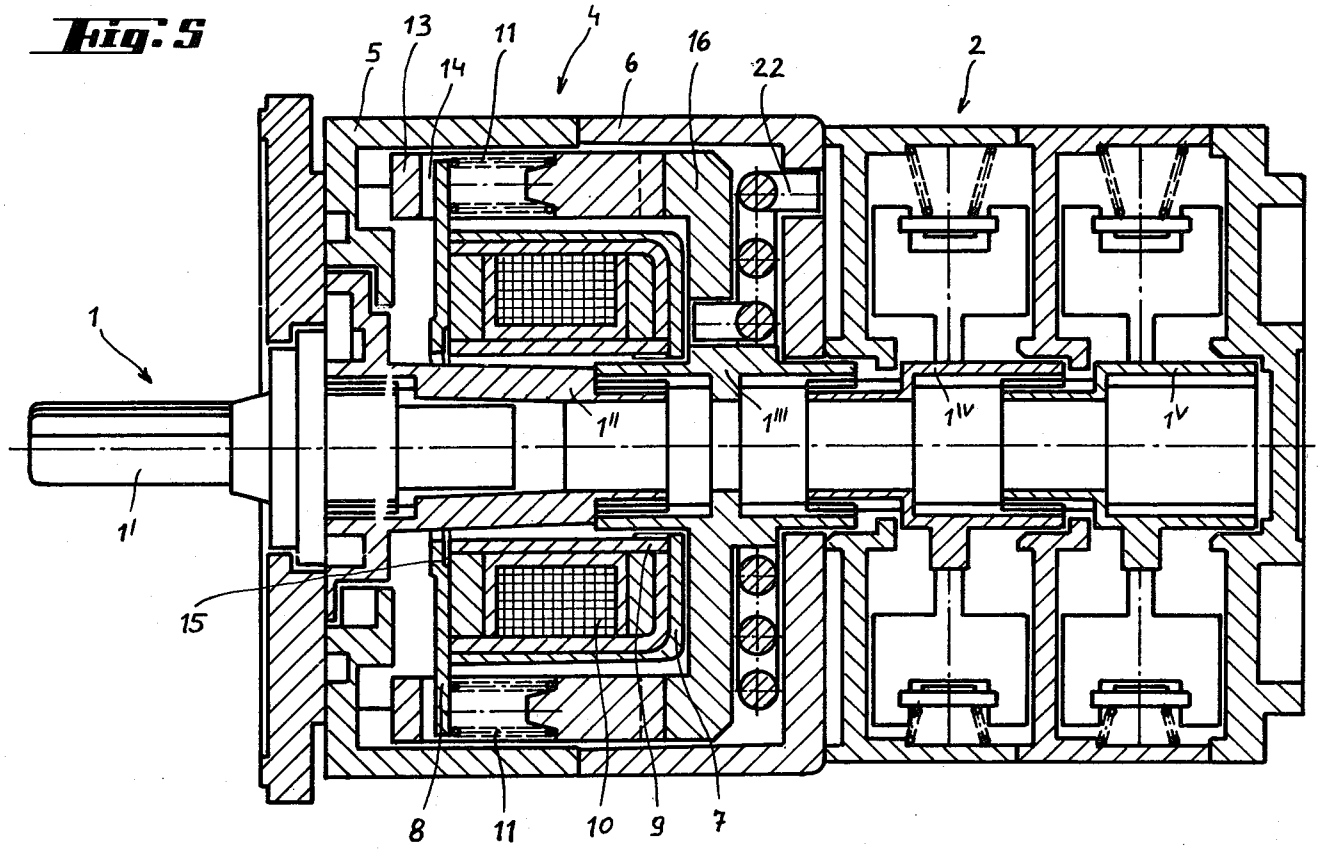
Figure 6:
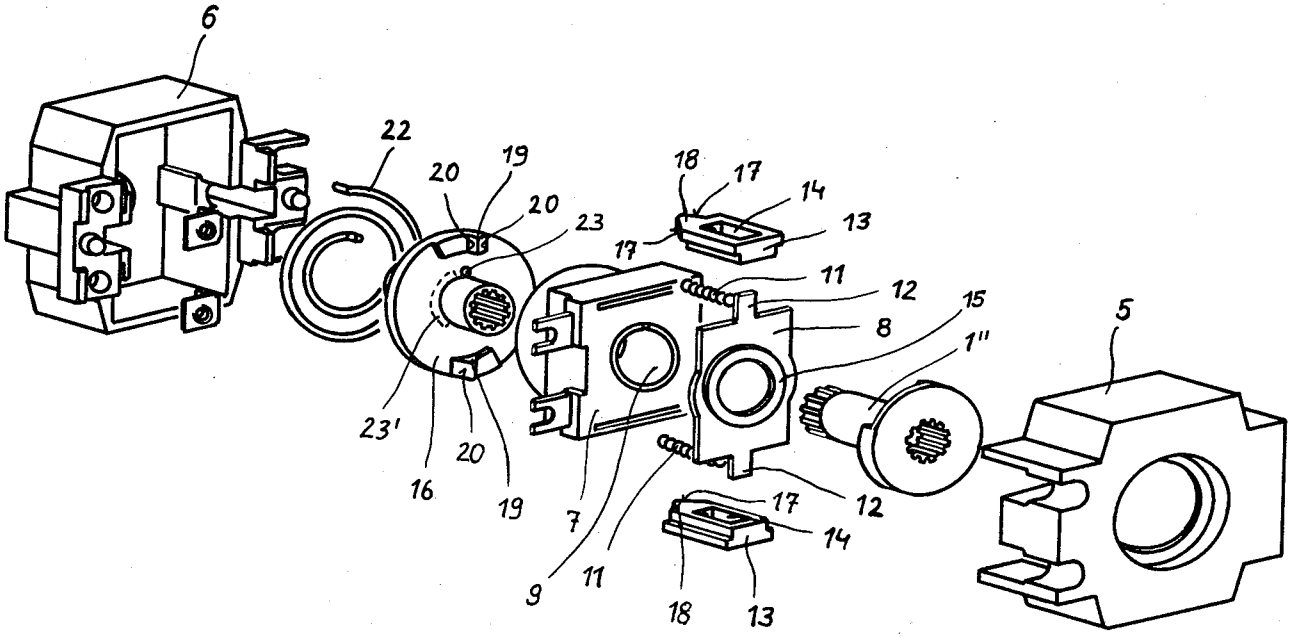
FIG. 6 shows an exploded drawing of the second embodiment of the resetting device.

In the embodiment of the resetting device 4' according to FIGS. 4–6, the restoring mechanisms 16' are replaced by the restoring mechanism 16 which is designed as a disc and which is integral with the shaft segment 1'''. This restoring mechanism 16 has two diametrically opposite projections 19 with oblique flanks 20 which, as in the embodiment according to FIGS. 1–3, interact with the projections 18 of the blocking tappets 13. Furthermore, the compression springs 21 are replaced by a coil spring 22, one end of which engages a bore 23 of the restoring mechanism 16 and the second end of which is anchored in the housing half 5. If spring 22 has no prestress in the starting position of the switch 2, the resetting device 4' can be used for switches rotatable to two sides, and such a switch can have several switching positions on both sides if the restoring mechanism 16 is provided with an appropriate number of projections 19.

If, however, because of the characteristic of the spring 22 a prestress is necessary in the starting position of the switch 2, the resetting device 4' can be adapted very simply for use with a switch having switching positions on both sides of a starting position. It is sufficient, for this purpose, as indicated by a broken line in FIG. 6, to replace the bore 23 by a slot 23' in the form of a circular segment, against the radially extending limiting walls of which rest the ends of two coil springs prestressed in opposite directions of rotation, so that in each direction of rotation one coil spring is tensioned and the other is relaxed.

Because of the oblique flanks 20 and 17 of the projections 19 and 18 and because of the control of the blocking tappets 13 by spring 11, the two embodiments illustrated permit a resetting of the switch 2 by hand. In principle, it would also be possible to connect the blocking tappets 13 rigidly to the armature 8 and to cause the blocking tappets to engage on the restoring mechanism 16 or mechanisms 16 16' on a face perpendicular or virtually perpendicular to the direction of movement of these, in which case it would, of course, be necessary to provide a spring, albeit a weak one, in order to ensure that the armature drops if the supply voltage falls appropriately far. In this case, the switch 2 could be reset only by breaking the circuit of the coil 10, in which case, however, a very weak and therefore small magnet system could be sufficient.

I claim:

1. In combination: a rotary switch comprising a drive shaft manually rotatable about an axis thereof for rotation from a starting to a selected switching position; and a resetting device for resetting the switch to the starting position when a supply voltage falls below a predetermined limiting value, the resetting device comprising (a) an electromagnet arranged coaxially on the drive shaft and connected to the supply voltage, the electromagnet having an armature movable into a retracted position in response to a supply voltage above the limiting value when the drive shaft is in the selected switching position, (b) a restoring mechanism loaded by a return spring to return the switch drive shaft to the starting position, the armature of the electromagnet being arranged for selectively releasing the restoring mechanism when the supply voltage is below the limiting value in the selected switching position of the drive shaft, (c) a blocking tappet axially slidable in relation to the drive shaft and movable for blocking the restoring mechanism in the retracted position of the armature, and (d) cooperating blocking means on the restoring mechanism and blocking tappet, the blocking means including complementary projecting and recess elements extending in the direction of the axis and adapted to interengage when the armature is in the retracted position and the rotary switch is in the switching position.

2. In the combination of claim 1, the restoring mechanism being movable in a plane perpendicular to the drive shaft.

3. In the conbination of claim 1, the electromagnet being a pot magnet having a core defining an axial bore, the drive shaft passing through the bore of the magnet core, and the armature being a plate having a bore, the drive shaft passing through the bore of the armature plate with play.

4. In the combination of claim 3, the armature having a projection engaging a recess in the blocking tappet, and further comprising a compression spring between the armature projection and a tappet recess wall.

5. In the combination of claim 1, the complementary recess and projecting elements on the restoring mechanism and the blocking tappet including complementary engaging faces extending obliquely to the respective moving direction of the restoring mechanism and blocking tappet.

6. In the combination of claim 1, the restoring mechanism being a disc keyed to the drive shaft for rotation therewith.

7. In the combination of claim 1, the restoring mechanism being a rack meshing with a pinion keyed to the drive shaft for rotation therewith.

* * * * *